US005808221A

United States Patent [19]

Ashour et al.

[11] Patent Number: 5,808,221

[45] Date of Patent: Sep. 15, 1998

[54] SOFTWARE-BASED AND HARDWARE-BASED HYBRID SYNTHESIZER

[75] Inventors: Gal Ashour, Nesher; Yoav Medan; Naftaly Sharir, both of Haifa, all of Israel

[73] Assignee: International Business Machines Corporation, Armonk, N.Y.

[21] Appl. No.: 723,172

[22] Filed: Sep. 30, 1996

[30] Foreign Application Priority Data

Oct. 3, 1995 [GB] United Kingdom ..... 9520124

[51] Int. Cl.[6] ..... G10H 1/08; G10H 7/02

[52] U.S. Cl. ..... 84/603; 84/604; 84/624; 84/625

[58] Field of Search ..... 84/601–607, 622–625, 84/659–661, 645

[56] References Cited

U.S. PATENT DOCUMENTS

| | | | |
|---|---|---|---|
| 4,922,794 | 5/1990 | Shibukawa | 84/601 |
| 5,094,136 | 3/1992 | Kudo et al. | 84/603 |
| 5,119,710 | 6/1992 | Tsurumi et al. | 84/601 X |
| 5,119,711 | 6/1992 | Bell et al. | 84/645 X |
| 5,121,667 | 6/1992 | Emery et al. | 84/603 |
| 5,192,824 | 3/1993 | Shibukawa | 84/625 X |
| 5,243,123 | 9/1993 | Chaya | 84/625 X |
| 5,376,750 | 12/1994 | Takeda et al. | 84/602 |
| 5,541,354 | 7/1996 | Farrett et al. | 84/603 |
| 5,567,900 | 10/1996 | Higashi | 84/602 |

*Primary Examiner*—Stanley J. Witkowski
*Attorney, Agent, or Firm*—Volel Emile

[57] ABSTRACT

An audio synthesizer is disclosed for generating an analog or digital audio output in response to coded control instructions representing musical events, such as a MIDI data stream. The synthesizer has a general purpose computer portion with a CPU programmed to receive the control instructions and generate audio samples and a special purpose hardware portion for receiving the control instructions and generating the audio samples. The synthesizer also has a controller for directing the control instructions either to the general purpose computer portion or to the hardware portion to generate the audio samples; and means to combine the audio samples generated by the general purpose computer portion and the hardware portion to form an audio output which accords with the control instructions.

21 Claims, 4 Drawing Sheets

SOFTWARE-BASED AND HARDWARE-BASED HYBRID SYNTHESIZER

TECHNICAL FIELD

The invention relates to audio synthesizers for generating digitally encoded audio samples in response to coded control instructions representing musical events, such as a MIDI data stream.

BACKGROUND OF THE INVENTION

Currently, most computers use sound cards or other dedicated hardware in order to produce music, for instance for games, composition and other multimedia applications. Typically, a dedicated sound card is plugged in the motherboard of the computer, although some recent personal computers have dedicated sound hardware located on the motherboard itself.

The main advantage of such hardware implementations is that even when the CPU of the computer is loaded to the extent of its power, the sound quality is not degraded.

However, an implementation entirely in hardware also has certain disadvantages. For example, the resources of the sound card are only used for the sound generation process and the machine cannot benefit from them in any other way. Software improvements on the computer, for example to the operating system, do not improve the sound quality or the performance since the sound card behaves as a semi-independent entity.

MIDI (Musical Instrument Digital Interface) is an internationally recognized specification for data communication between digital electronic musical instruments and other devices, such as computers, lighting controllers, mixers or the like. The MIDI data specifies performance information, as opposed to sound information. For example, which note or notes are being held down, if any additional pressure is applied to the note after being struck, when the key is released and any other adjustments made to the settings of the instrument. MIDI data is communicated as a serial data stream organized into MIDI 'messages', which contain one MIDI command or event.

In a conventional MIDI playback system, a MIDI synthesizer is controlled by a stream of MIDI messages. The synthesizer receives and decodes the messages and operates accordingly. For example, a 'NOTE ON' event will cause the synthesizer to generate audio samples that correspond to a requested note and velocity that are supplied as parameters. Similarly, a 'NOTE OFF' event will cause the synthesizer to cease generating the audio samples.

Most commercially available sound cards have the capability of acting as MIDI synthesizers by receiving data from MIDI sources either through a MIDI port or via the PC bus.

Software-only MIDI synthesizers have been proposed for use with general purpose computers. These can take advantage of all the resources of the computer, such as CPU power, memory, magnetic and CD-ROM storage, caching mechanisms and virtual memory and are easily customized, upgraded and maintained. However, they have the disadvantage that the sound quality can be degraded when the computing resources they require are not available due to other tasks the computer may be performing. Nevertheless, in recent years the power available from the processors used in personal computers has increased significantly and, in normal use, the load on the CPU can be quite low for much of the time.

SUMMARY OF THE INVENTION

This invention is directed to providing an audio synthesizer of the above defined type which combines the advantages of hardware and software implementations.

To achieve this aim, there is now provided an audio synthesizer for generating an analog or digital audio output in response to coded control instructions representing musical events. The synthesizer uses a general purpose computer portion having a CPU programmed to receive the control instructions and to generate audio samples. The synthesizer also uses a special purpose hardware portion for receiving the control instructions and for generating audio samples. A controller is used to direct some of the control instructions to the general purpose computer portion and some others to the hardware portion. The audio samples generated by the general purpose computer portion and those generated by the hardware portion are combined to form an audio output which accords with the control instructions.

This provides a hybrid audio synthesizer which combines advantages from both software and hardware implementations and enables the spare computing power of the host CPU to be used to supplement that of the sound card.

An embodiment of such a synthesizer has been developed for use with a MIDI data stream, however application of analogous techniques to other forms of control instructions is not excluded.

In a preferred embodiment the audio synthesizer uses a mechanisms for repeatedly measuring the load on the CPU. The controller is arranged to direct the control instructions according to the measured load on the CPU. The CPU usage can be measured, for example, by timing the synthesis internal loop, which is the computation intensive loop, although other methods for determining the CPU usage are possible.

In this case, when the CPU is not highly loaded, the hybrid synthesizer can handle some of the MIDI events in software using the native CPU, while propagating some of the events to the hardware portion. The decision as to how many simultaneous notes should be handled in software and how many in hardware is based on the current CPU usage.

The general purpose computer can be programmed to act as the controller and to either generate the audio samples itself or to transfer the instructions to the hardware portion. Alternatively, the controller could be implemented as part of the special purpose hardware.

Advantageously, the controller is arranged to direct the instructions according to voice-type. In this way, the audio synthesizer can be arranged so that a predefined set of voices are handled by the general purpose computer portion and thus the quality of the sound can be improved by directing instructions relating to particular instruments either to the software or the hardware synthesizers according to whether they are best suited to the particular synthesis method used.

The audio synthesizer can include delay means for delaying the direction of control instructions to the hardware portion, so that the audio samples generated by the hardware portion are synchronized with the audio samples generated by the general purpose computer.

In one particularly preferred embodiment, the synthesis on the main CPU can be done using a wave-table synthesis, while using a relatively cheap sound card which only supports FM synthesis. In this case, both quality of the produced music and the overall performance are greatly improved.

Preferably, the synthesizer includes an input for receiving audio samples and mechanism for mixing audio samples received at the input with audio samples generated in response to the coded control instructions. This allows wave messages to be received from other sources and mixed with the wave data generated by the synthesizer.

In one implementation, the audio synthesizer can take the form of a personal computer with an add-on sound card, although, of course, many other configurations are possible.

Viewing the invention from a second aspect, there is provided a method of operating an audio synthesizer to generate an analog or digital audio output in response to coded control instructions representing musical events. The synthesizer uses a general purpose computer portion having a CPU programmed to receive the control instructions and to generate audio samples. A special purpose hardware portion is also used to receive control instructions and to generate audio samples. The method entails directing the control instructions either so that the general purpose computer portion generates the audio samples or so that the hardware portion generates the audio samples. The audio samples generated by the general purpose computer portion and those generated by the hardware portion are combined to form an audio output which accords with the control instructions.

Suitably, it can be arranged that the audio samples can be combined to accord with the control instructions by delaying the direction of control instructions to the hardware portion, so that the audio samples generated by the hardware portion are synchronized with the audio samples generated by the general purpose computer.

In a preferred embodiment the method entails receiving a NOTE ON instruction; determining whether the NOTE ON instruction is for a predefined set of voices to be handled by the general purpose computer portion and, if not, directing the NOTE ON instruction so that the hardware portion generates corresponding audio samples; measuring the CPU load and if the CPU load exceeds a predefined threshold, directing the NOTE ON instruction so that the hardware portion generates corresponding audio samples; otherwise directing the NOTE ON instruction so that the general purpose computer portion generates the audio samples.

In this embodiment the method further entails: receiving a NOTE OFF instruction; determining whether the NOTE OFF instruction relates to a note being handled by the general purpose computer portion and, if not, directing the NOTE OFF instruction to the hardware portion; otherwise directing the NOTE OFF instruction to the general purpose computer portion.

The invention can be implemented in the form of an article of manufacture having a computer usable medium in which program code is embodied for causing a computer to perform the above described methods.

BRIEF DESCRIPTION OF THE DRAWINGS

An embodiment of the invention will now be described by way of example only with reference to the accompanying drawings, wherein.

DETAILED DESCRIPTION OF THE PREFERRED EMBODIMENT

Figure 1:
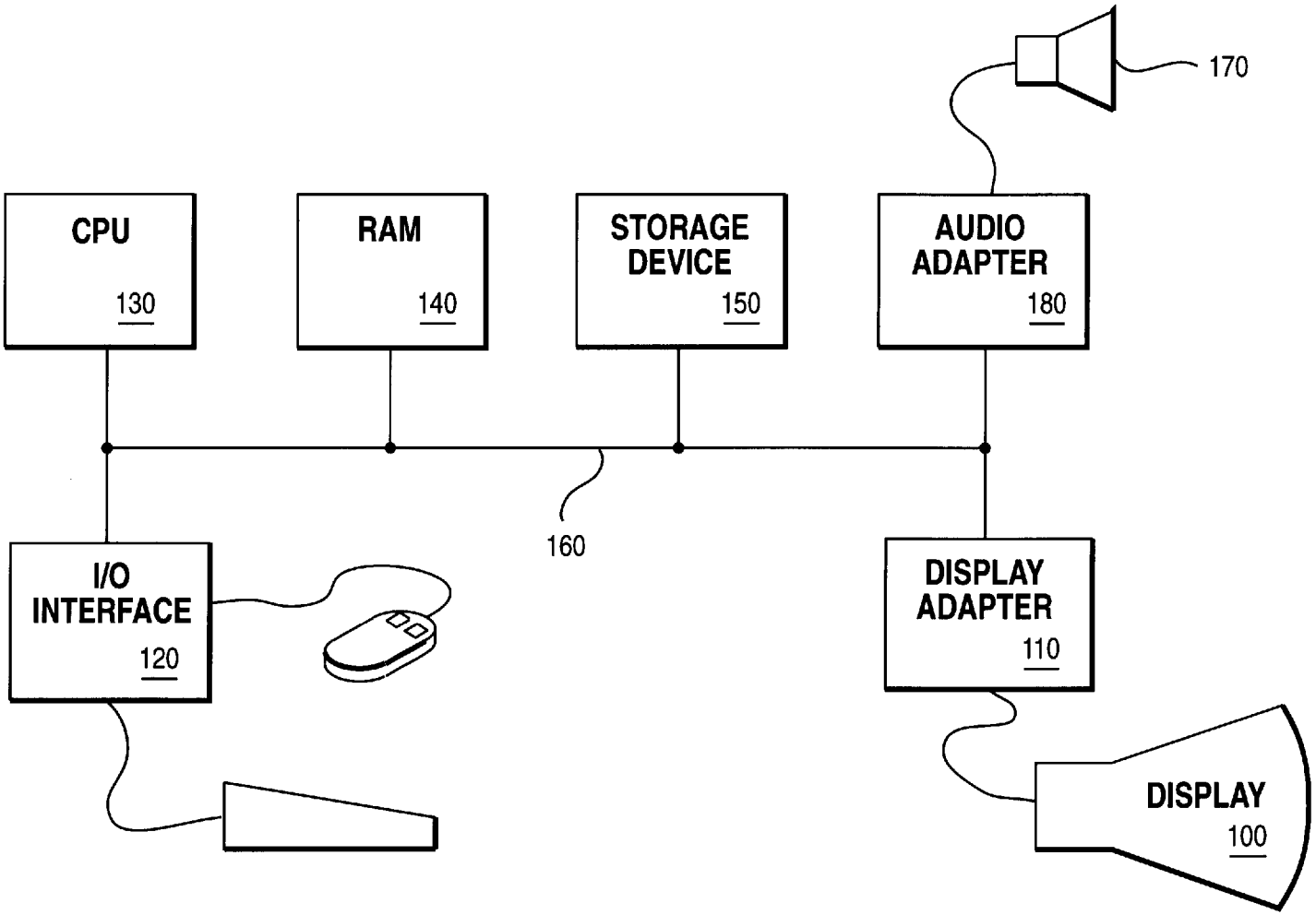
FIG. 1 is a schematic diagram showing a personal computer.

FIG. 1 is a schematic diagram showing a personal computer arranged to function as an audio synthesizer. The computer comprises conventional components such as display device 100 and associated display adapter 110, and I/O interface 120 to which is attached a keyboard and a mouse. The computer also comprises a CPU 130, RAM 140 and a magnetic storage device 150. These components are arranged to intercommunicate via a bus 160 in conventional manner.

The computer also comprises an audio adapter 180 which is capable of implementing a MIDI synthesizer by utilizing a digital signal processor. Audio adapter 180 is shown connected to one or more loudspeakers indicated at 170.

The system shown in FIG. 1 may be implemented by using an IBM PS/2 computer available from IBM Corporation and a SoundBlaster 16 Value Edition card available from Creative Labs Inc (IBM and PS/2 are trademarks of IBM Corporation and SoundBlaster is a trade mark of Creative Technology Inc).

Figure 2:
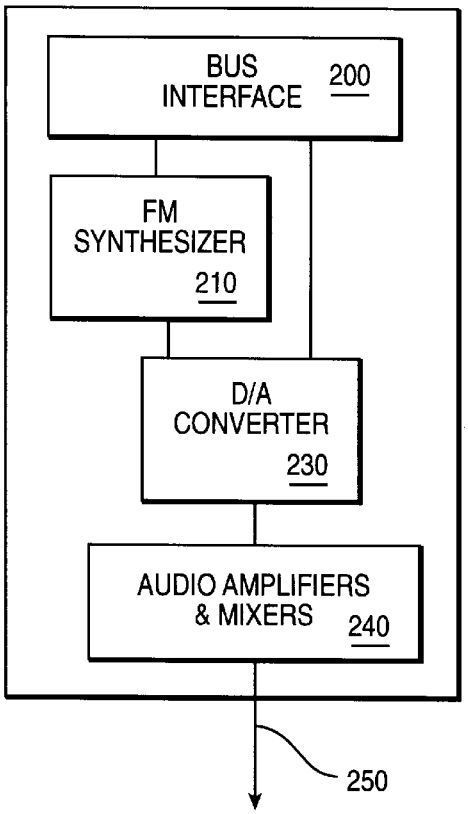
FIG. 2 is a simplified schematic functional block diagram of a sound card.

FIG. 2 shows a simplified functional block diagram of the relevant parts of the adapter. It comprises bus interface logic 200, FM synthesizer 210, digital to analog converter 230 and audio amplifiers and mixers 240. Of course, in other embodiments synthesizer 210 could be any other kind of synthesizer, eg a wavetable or waveguide synthesizer. The card has an audio output indicated at 250, though the audio samples might equally be output in digital form for digital recording or processing via an external D/A converter. The structure and general operation of such a card will be well known to those skilled in the art and will not be discussed further herein. The card is capable of simultaneously accepting and combining both MIDI events and wave samples sent from the computer.

MIDI data is communicated as a serial data stream organized into MIDI 'messages', which contain one MIDI command or event. MIDI commands are usually composed of one, two, or three bytes of data arranged and transmitted one after another. The first byte sent in each command is called the 'status' byte and specifies an operation to be performed. The next one or two bytes, if used, represent parameters of this command. For example, a NOTE ON command comprises three bytes, the first of which is the status byte. This byte tells a synthesizer to play a note and specifies the channel number. The channel number usually represents the type of sound to be played, i.e. which instrument of the synthesizer is to be used. The second byte specifies the note to be played and the third byte specifies the velocity value for the note. The bytes of the MIDI commands are specified in the MIDI standard.

In a conventional MIDI playback system a MIDI synthesizer can be controlled by a MIDI sequencer in the following way. A standard MIDI file (SMF) contains a set of events, which are intended to be executed by a synthesizer at particular times. Generally, the events are not uniformly spaced in time. A conventional MIDI sequencer parses the standard MIDI file, reads the present MIDI event and the time difference between it and the next event. The sequencer then sends the event in a MIDI message to a MIDI synthesizer at the time it is to be executed. The sequencer usually sets a timer and reads the next MIDI event after this time difference has elapsed.

A conventional MIDI synthesizer receives the MIDI message that the sequencer sends, decodes the message and operates accordingly. For example, a 'NOTE ON' event will cause the synthesizer to generate audio samples that correspond to a requested note and velocity that are supplied as parameters. Similarly, a 'NOTE OFF' event will cause the synthesizer to cease generating the audio samples.

In this system a software MIDI synthesizer is implemented as Dynamic Link Library (DLL). This DLL handles some of the notes in software, while propagating the rest of the notes to the sound card according to performance and quality criteria.

Figure 3:
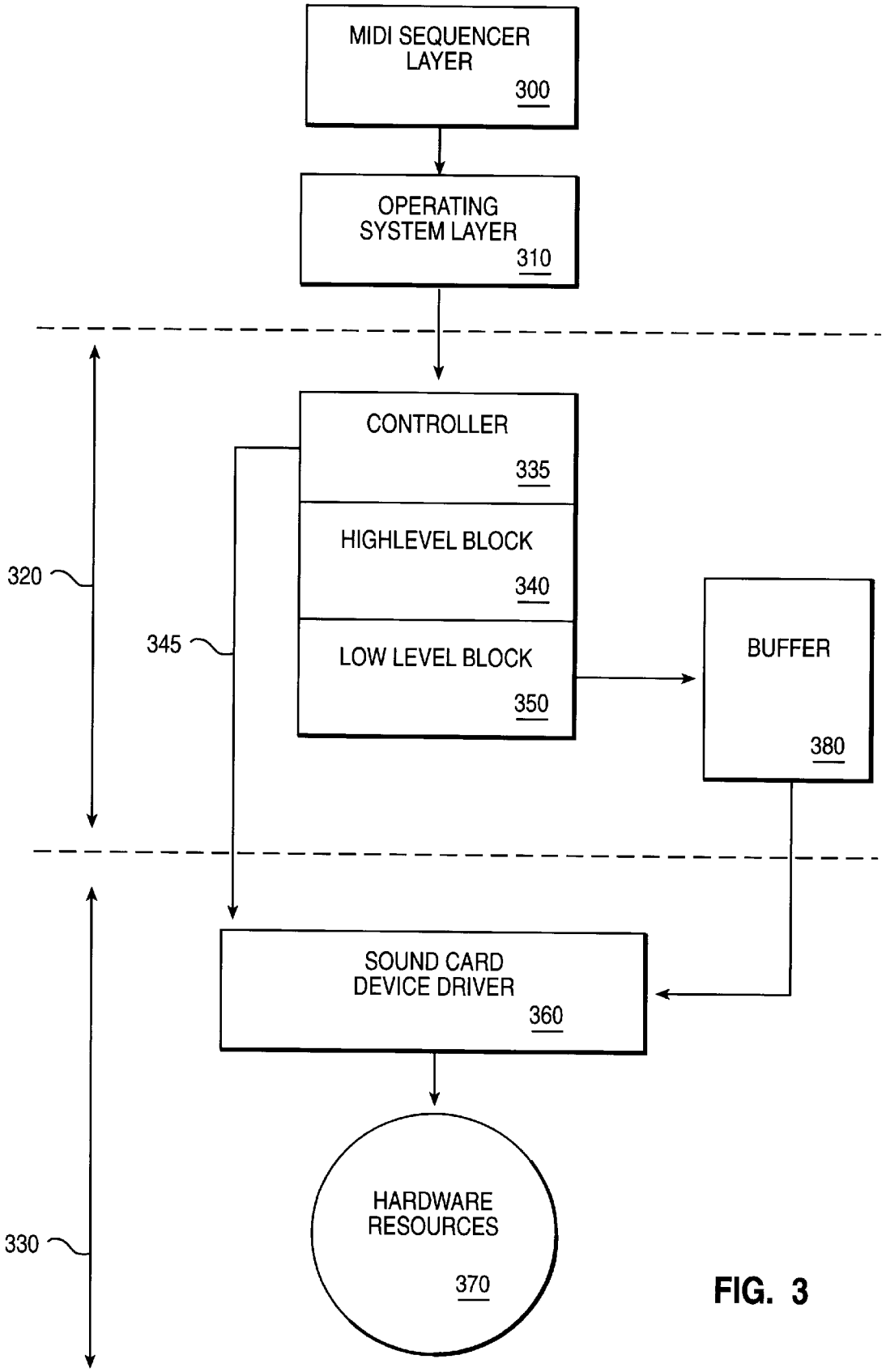
FIG. 3 is a schematic diagram showing the software structure of an audio synthesizer.

A schematic diagram of the software components in the present implementation is shown in FIG. 3. The system comprises a MIDI sequencer application layer 300, an operating system layer 310, a DLL layer indicated at 320 and a sound card layer 330.

DLL layer 320 comprises 3 main blocks, controller 335, high level block 340 and low level block 350. Sound card layer 330 comprises a sound card device driver 360 and the hardware resources of the sound card which are indicated at 370. Also shown in FIG. 3 is an output buffer 380.

The DLL layer 320 is triggered by MIDI messages which are sent by MIDI sequencer. These messages can be sent directly by application 300 or via the operating system services.

Controller 335 is responsible for the MIDI logic management. In other words, this block decides which notes are to be propagated to the sound card and which should be handled entirely by means of software synthesis. NOTE ON and NOTE OFF messages for notes to be handled on the sound card are sent, after a suitable delay to maintain synchronization, directly to the sound card via line 345. Other messages are sent to both the sound card and the software synthesizer as will be described in more detail below.

The decision regarding which notes to handle by software, and which notes to propagate to the sound card takes the following considerations into account.

1. In the special case where the software DLL supports wave-table synthesis and the sound card supports only FM synthesis, there is an advantage in handling instruments which cannot be realistically synthesized by FM synthesis, such as acoustic instruments like violin, acoustic piano, clarinet etc, in software, while propagating to the sound card notes related to instruments that are not damaged by the FM synthesis, such as electric piano, electronic synthesizer effects, etc.
2. If there is insufficient CPU power to handle any further notes in software, then any further NOTE ON messages received should be propagated to the sound card. On the other hand if the CPU is relatively idle, it can participate in the synthesis process and thus improve the overall performance. In case of overload, the controller 335 is arranged to dynamically reduce the number of soft-voices, i.e. the number of notes that are currently synthesized by means of software, down to a limit of zero by directing any further NOTE ON messages to the sound card.
3. The number of empty slots on the sound card. Each empty slot is capable of playing one note. The number of slots supported by the sound card represents the maximum number of notes that the sound card can play simultaneously.

High level block 340 receives the messages which are to be handled in software and updates the various internal tables which are used by the synthesizer. It handles conventional functions of a MIDI synthesizer such as managing voice allocation etc which are not directly relevant to the present invention and will be well understood by those skilled in the art.

Figure 4:
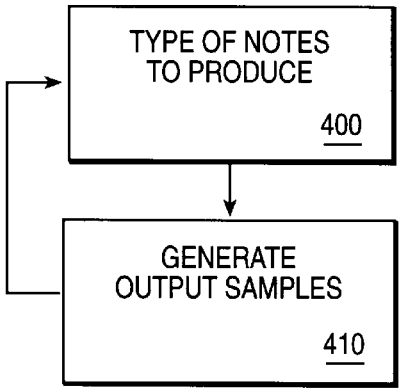
FIG. 4 is a flow diagram showing the synthesis loop of a software synthesizer.

Low level block 350 is triggered periodically and contains the synthesis engine which requires intensive computation. This block is responsible for the synthesis of notes that are not propagated to the sound card by controller 335. The general operation of the low level block is shown in FIG. 4. The loop is generally triggered with a time period of between 1 mS and 5 mS. Each time the loop is triggered it checks in step 400 for each voice which kind of note is to be produced and looks in the Wave Table database to find the appropriate waveform. The waveform for each active voice is then transformed if necessary to the correct pitch and the waveforms combined to generate output samples—step 410—at a suitable sampling rate, for example 44100 samples per second, and places them in buffer 380 for retrieval by the device driver 360 in sound card layer 330.

Since the synthesis algorithm is computationally very intensive, it can be used for monitoring the CPU usage. This measure of the CPU usage is available to controller 335 to enable it to decide whether notes should be propagated to the sound card.

There are a number of ways that the CPU usage can be monitored via the synthesis process. For example, a time measurement can be taken each time the low-level block 340 is triggered. If the difference between the current time and the time that was measured on the previous iteration is consistently larger than the requested period, then it can be assumed that the CPU is overloaded.

Alternatively, a time measurement can be taken at the beginning and at the end of the synthesis process in each iteration. The difference between these two measurements is approximated to be the CPU time which is used for the current number of soft voices. The CPU usage in percentage is then calculated as the ratio of the measured synthesis time and the time interval which is used as the triggering period for the low level block 350.

Figure 5:
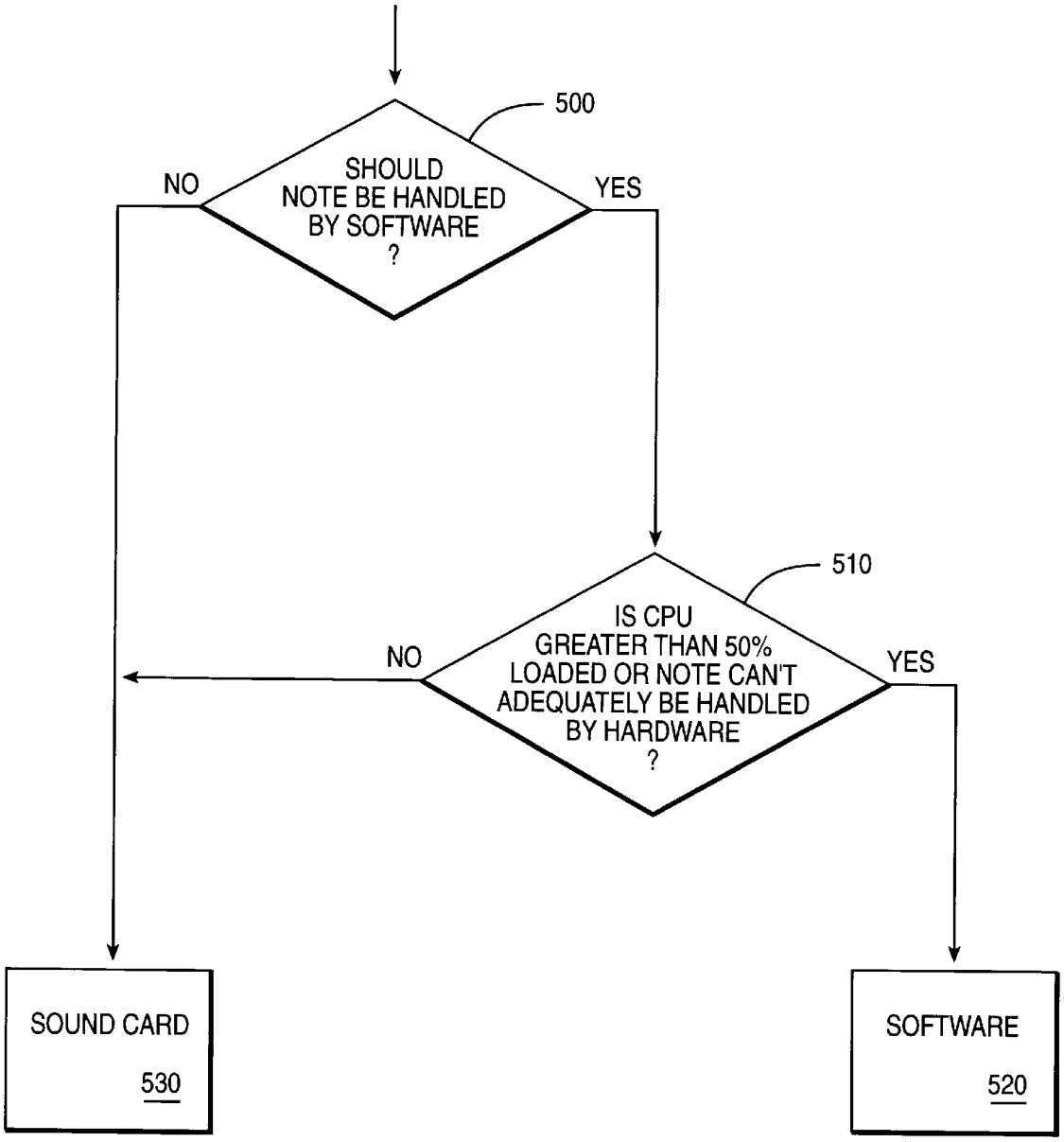
FIG. 5 is a flow diagram showing the process on receipt of a NOTE ON MIDI message.

Controller 335 directs all MIDI messages, apart from NOTE ON and NOTE OFF messages to both the sound card and the high level block 340. In the case of NOTE ON and NOTE OFF messages, the processes shown in FIGS. 5 and 6 respectively are performed.

In the case of a NOTE ON command it is determined in step 500 whether the instrument to which the note relates is one which a priori should be handled in software because of its nature. If so, then a determination of the CPU load is made in step 510 and if the CPU load is less than a fixed limit the NOTE ON message is directed to high level block 340 and the note is handled in software—step 520. If the CPU is greater than 50% loaded or the instrument to which the note relates can be adequately handled by the sound card, then the NOTE ON command is directed to the sound card—step 530.

Figure 6:
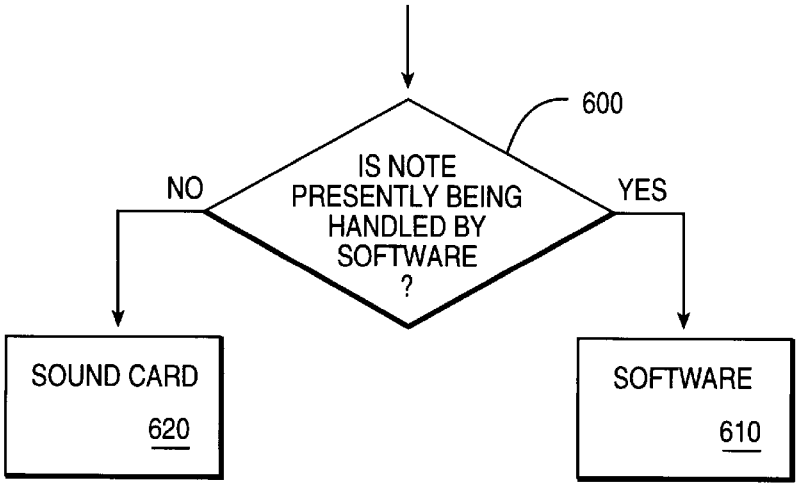
FIG. 6 is a flow diagram showing the process on receipt of a NOTE OFF MIDI message.

On receipt of a NOTE OFF command, it is determined, in step 600 in FIG. 6, whether the voice concerned is presently being handled in software. This information is available in the tables maintained by high level block 340. If the note is being handled in software, then the NOTE OFF message is directed to high level block 340—step 610, if not then the NOTE OFF message is directed to the sound card—step 620.

It will be appreciated that there is a need to delay propagation of MIDI events to be handled in the sound card to maintain synchronization between the samples produced in software and those produced in hardware. This will be a constant, but processor and/or sound card-dependant delay and in the present arrangement can be set manually by the user via a suitable menu presented to them. Determination of the correct delay may be easily established empirically by the user.

The present implementation has been written to work under the well known Windows operating system from Microsoft Corp (Windows is a trademark of Microsoft Corp.). The general operation of the system is as follows. First the user invokes a Windows application, such as a sequencer, which requires a MIDI synthesizer. The application opens the MIDI synthesizer DLL via the MIDI Mapper program, with the intervention of the MMSYSTEM driver.

The software MIDI Synthesizer DLL opens the sound card twice—once as a MIDI device to which MIDI messages will be propagated and once as a WAVE device to which the wave samples produced by the software MIDI synthesizer will be sent.

Since the software synthesizer locks the WAVE input of the sound card, it is itself provided with a WAVE input to receive WAVE messages from other sources and handle the mixing of these with the wave data it generates. MIDI messages for instruments for which the sound quality is acceptable using FM synthesis are propagated to the sound card and handled in hardware.

The software MIDI synthesizer handles the MIDI messages for instruments which require Wave-table synthesis up to a fixed limit, such as 50%, of the available CPU power. In case of overload, the software synthesizer dynamically reduces the number of soft-voices, i.e. the number of notes that are currently synthesized by means of software down to a limit of zero. As described above, this is achieved by directing any further NOTE ON messages to the sound card.

As will be clear from the above description, the present implementation takes the form of a computer program and can be distributed in the form of an article of manufacture comprising a computer usable medium in which suitable program code is embodied for causing a computer to perform the function of controller 335 described above. The program may include the high level block 340 and 350 and low level blocks of the software synthesizer or could be implemented for use with a preexisting software synthesizer.

However, it will be appreciated that many variations are possible within the scope of the attached claims. For example, the controller might be implemented on the sound card itself, either in hardware or software, and arranged to receive MIDI messages from an external source, the sound card handling some notes itself and directing some notes over the PC bus to a software synthesizer.

Industrial Applicability

The invention is applicable in the technical field of computers and digital audio systems.

What is claimed is:

1. A hybrid synthesizer for generating audio outputs in response to coded control instructions comprising:

a software-based synthesizer for generating first audio samples in response to first coded control instruction inputs;

a hardware-based synthesizer for generating second audio samples in response to second coded control instruction inputs;

means for determining an operating load of a processor, said processor processing said inputs to said software-based synthesizer;

a controller for distributing said coded control instructions as inputs to said software-based synthesizer and said hardware-based synthesizer based on said operating load of said processor; and means for combining said first audio samples with said second audio samples to form an audio output which accords with said coded control instructions.

2. The hybrid synthesizer of claim 1 wherein the determining means includes timing means for timing a synthesis loop in a program driving said software-based synthesizer.

3. The hybrid synthesizer of claim 2 wherein said processor functions as said controller.

4. The hybrid synthesizer of claim 3 in which said software-based synthesizer includes a wave-table for generating said first audio samples and said hardware-based synthesizer includes an FM synthesizer for generating said second audio samples.

5. The hybrid synthesizer of claim 4 including delay means for delaying said inputs to said hardware-based synthesizer to allow said second audio samples to be synchronized with said first audio samples.

6. The hybrid synthesizer of claim 5 including an input for receiving external audio samples and means for mixing said external audio samples with said first and/or said second audio samples.

7. The hybrid synthesizer of claim 1 in which said controller distributes said inputs according to a voice type.

8. A method of generating audio outputs in response to coded control instructions comprising the steps of:

generating first audio samples in response to first control instruction inputs to a software-based synthesizer;

generating second audio samples in response to second control instruction inputs to a hardware-based synthesizer;

determining an operating load of a central processing unit (CPU), said CPU processing said inputs to said software-based synthesizer;

distributing coded control instructions as inputs to said software-based synthesizer and said hardware-based synthesizer based on said operating load of said CPU; and combining said first audio samples with said second audio samples to form an audio output which accords with said coded control instructions.

9. The method of claim 8 wherein the step of determining includes timing a synthesis loop in a program driving said software-based synthesizer.

10. The method of claim 9 wherein said CPU is used as said controller.

11. The method of claim 10 in which said step of generating said first audio samples includes using a wave-table and said step of generating said second audio samples includes using an FM synthesizer.

12. The method of claim 11 including the step of delaying said inputs to said hardware-based synthesizer to allow said second audio samples to be synchronized with said first audio samples.

13. The method of claim 12 further comprising the step of mixing external audio samples received at an input with said first and/or said second audio samples.

14. The method of claim 8 in which the step of distributing said inputs is based on voice type.

15. A system for generating audio outputs comprising:

at least one processor for processing data;

a software-based synthesizer for generating first audio samples in response to data in the form of first control instruction inputs;

a hardware-based synthesizer for generating second audio samples in response to data in the form of second control instruction inputs;

means for determining an operating load of said at least one processor, said at least one processor processing said inputs to said software-based synthesizer;

a controller for distributing coded control instructions as inputs to said software-based synthesizer and said hardware-based synthesizer based on said operating load of said at least one processor; and means for combining said first audio samples with said second audio samples to form an audio output which accords with coded control instructions.

16. The system of claim 15 wherein the determining means includes timing means for timing a synthesis loop in a program driving said software-based synthesizer.

17. The system of claim 16 wherein said at least one processor functions as said controller.

18. The system of claim 17 in which said software-based synthesizer includes a wave-table for generating said first audio samples and said hardware-based synthesizer includes an FM synthesizer for generating said second audio samples.

19. The system of claim 18 including delay means for delaying said inputs to said hardware-based synthesizer to allow said second audio samples to be synchronized with said first audio samples.

20. The system of claim 19 including an input for receiving external audio samples and means for mixing said external audio samples with said first and/or said second audio samples.

21. The system of claim 15 in which said controller distributes said inputs according to voice type.

* * * * *